United States Patent [19]

Christensen

[11] Patent Number: 5,062,139

[45] Date of Patent: Oct. 29, 1991

[54] COAXIAL LOUD SPEAKER SYSTEM

[76] Inventor: Eugene J. Christensen, R.R. #2, Box 2297, Lake George, N.Y. 12845

[21] Appl. No.: 361,351

[22] Filed: Jun. 5, 1989

[51] Int. Cl.[5] ..... H04R 25/00

[52] U.S. Cl. ..... 381/192; 381/182; 381/186; 381/173; 381/190; 381/202; 381/204

[58] Field of Search ..... 381/182, 185, 192, 195, 381/184, 190, 173; 181/144, 161, 163, 164, 165; 310/324, 332

[56] References Cited

U.S. PATENT DOCUMENTS

| | | | |
|---|---|---|---|
| 1,815,987 | 7/1931 | Peterson | 181/164 |
| 2,231,479 | 2/1941 | Perry | 381/186 |
| 2,269,284 | 1/1942 | Olson | 381/156 |
| 2,426,948 | 9/1947 | Preston | 381/182 |
| 2,539,672 | 1/1951 | Olson et al. | 381/184 |
| 2,699,472 | 1/1955 | Olson et al. | 381/195 |
| 4,246,447 | 1/1981 | Vorie | 381/162 |
| 4,497,981 | 2/1985 | House | 381/182 |
| 4,554,414 | 11/1985 | House | 381/182 |
| 4,590,333 | 5/1986 | Strohbeen | 381/195 |

FOREIGN PATENT DOCUMENTS

| | | | |
|---|---|---|---|
| 0012700 | 1/1984 | Japan | 381/190 |
| 0665815 | 1/1952 | United Kingdom | 381/195 |

*Primary Examiner*—James L. Dwyer
*Assistant Examiner*—Jason Chan
*Attorney, Agent, or Firm*—Schmeiser, Morelle & Watts

[57] ABSTRACT

A multi-driver, coaxially mounted loud speaker array utilizing a high frequency bi-morph driving element that is totally contained within the hollow core of the voice coil former of a lower frequency loud speaker. The outwardly radiating conical edge of the high frequency device's diaphragm is annularly fixed by a compliance to the inner surface of the referenced voice coil former or to the diaphragm which radiates outwardly therefrom and is excited by the former. A significant advancement in the art is acquired by the realization of a cavity between the situs of the bi-morph driving element and the back of the former—excited diaphragm, behind the annular compliance. This feature allows a design engineer to literally tune the response of the higher frequency loud speaker by deliberately varying the volume of the cavity.

9 Claims, 6 Drawing Sheets

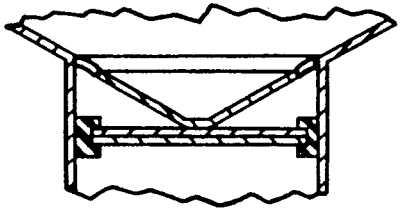
FIG. 7AI
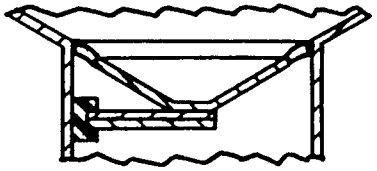
FIG. 7AII
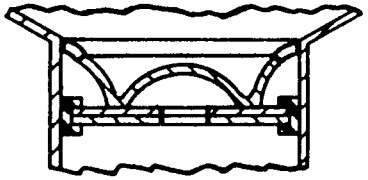
FIG. 7AIII
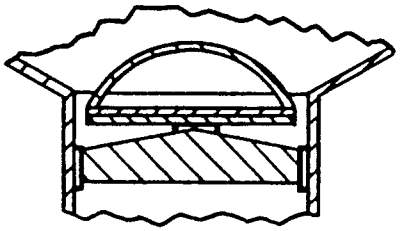
FIG. 7BI
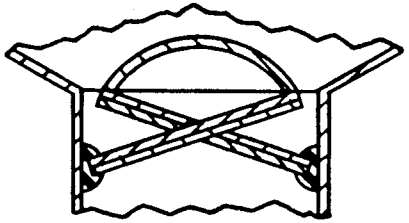
FIG. 7BII
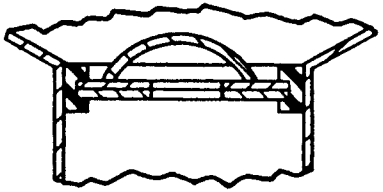
FIG. 7BIII
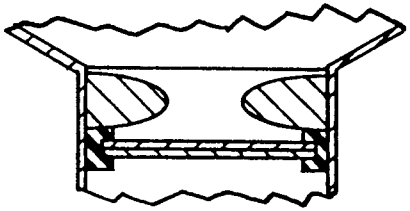
FIG. 7CI
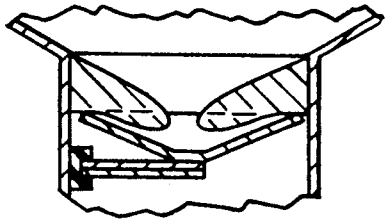
FIG. 7CII
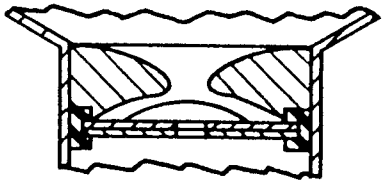
FIG. 7CIII

COAXIAL LOUD SPEAKER SYSTEM

BACKGROUND OF THE INVENTION

1. Field of the Invention

This invention relates generally to loud speaker systems, and more particularly to a system in which the audio frequency is divided into upper and lower ranges. The instant invention concerns itself with the particular location of a high-frequency (HF) transducer with respect to certain elements of a low-frequency (LF) transducer, and the particular means for attachment of various elements of the high-frequency transducer to the various elements of the low-frequency transducer. The collocation of both high- and low-frequency transducers on the same axis is referred to herein as coaxial mounting.

2. Prior Art Discussion

The goal in loud speaker design is to create a device which will accurately transform an electrical signal wave form voltage into an exact replica of the orginal acoustic pressure wave form which created it. The typical music wave form is a complicated combination of continuous tones overtones and transient sounds. Also, several instruments or voices are usually superimposed and thus, the total wave form can be thought of as the summation of all the different frequencies which make up the sound, as preceived by the listener. The primary characteristics of sound wave forms are phase, amplitude and frequency. The first, phase, refers to the timing relationship of the various frequencies and the transients as they reach the listener's ear. Amplitude is relative size, magnitude or intensity of the various frequencies and transients; and, frequency refers to the number of cycles per second of the audio signal, (termed) its pitch. It is possible to identify each instrument or voice of a sound replication by its distinctive combination of overtones and by its location in the stereophonic image. Because of such physiological characteristics as persistence, the human ear is fooled into a "recognition" of the original sound. It follows then that the ideal speaker device (also referred to herein as a "transducer") is one which is perfectly faithful in phase, amplitude and frequency response—high fidelity, or high "faithfulness".

In the beginning of high fidelity sound replication, the most prevalent form of loud speaker, or electro-audio transducer, was the dynamic radiator speaker. This device essentially comprised a permanent magnet with an air gap and a concentric pole piece on which was mounted a hollow, nonmagnetic, conducting shell known as a former and which was wrapped with an insulated wire termed a voice coil. The former was directly coupled at its outer margin to the apex or minor perimetral margin of a conical paper shell, known as a diaphragm and which projected outward of the permanent magnet assembly. As the voice coil was excited within its permanent magnet environment, the voice coil moved longitudinally and the diaphragm was caused to vibrate, thus replicating the audio (air pressure dynamic) signal that had generated the electrical current passing through the voice coil by pressing dynamically on the contact air mass in front of the diaphragm. The dynamic radiator had several characteristics that were noteworthy, and necessary, to the high fidelity replication of sound at that time: it was relatively efficient; it had a fairly wide frequency range; and it could be used as a low-range, mid-range or high-range electro-audio transducer. Concomitantly, the dynamic radiator has notable limitations: a single driver cannot cover the entire audible frequency range of 20 hz. to 20 KHZ; multiple drivers (coils) must be used for different parts of the audio spectrum; cross over circuits must be used to separate the audio spectrum; and oftentimes, heavy magnets and rigid support frames are necessary to construct the assembly.

The quest for high fidelity sound reproduction which began in the early 40's, has continued unabated to the present. Of significant relevance to the instant invention is U.S. Pat. No. 2,269,284, issued to Olson in 1942. This patent, referred to in a host of applications since that time, has set the stage for much of the sound reproduction devices relating to high fidelity and stereophonic sound. Olson taught, basically, the coaxial arrangement of multiple speakers, one within the other, and aligned along a central, common core. In the Olson art, the diaphragms of the various loud speakers are generally conically shaped and are arranged in nested, overlapping relationship with their cylindrical driving coils that are arranged concentrically, and in radially spaced relationship, in the air gap formed between the pole pieces of a suitable magnetic structure. The base conical section, or low range speaker (hereinafter referred to as a "woofer") is the first of the loud speakers to be mounted, relative the pole piece. Thereafter, succeedingly smaller conical sections of the relatively smaller loud speakers are nested one within the other, digressing in size to the physically smallest, highest frequency range electro-audio transducer (hereinafter referred to as "tweeter"), with all their diaphragms and respective driving coils forward of the base woofer assembly. Many modifications of the basic invention are referred to in the Olson patent, but it may be generally summarized as a system having the equivalent of large cones and coils for the low audio frequencies, medium size cones and coils for mid-range sound reproduction, and small cones and coils for high-frequency reproduction. The voice coils are generally connected in series with a predetermined capacitance connected across each of the specific coils. With such an arrangement, at low frequencies, signal flows through all three coils. Concurrently, the reactance and the compliances are small compared to the mass reactance of the several coils; thus, all parts of the system move in (with the same) phase. In the mid-range, very little current will flow through the woofer coil because of the effective shunt provided by its capacitance. The mass reactance of the coil is large compared to the compliance; therefore, at such ranges, the diaphragms of both the mid-range and high-range cones are driven by their respective coils. At the high frequencies, the compliance between the tweeter coil and the mid-range coil is small compared to the mass reactance of the mid-range coil, and practically all the current flows in the tweeter coil because of the shunting effected by the woofer and mid-range capacitors, causing the tweeter driver to vibrate its respective cone and produce the desired audio radiation at the higher frequencies. It may be generally said that since Olson, most of the significant advancements have been made in the placement of the various mid-range and high-range (tweeter) transducers, as well as in the use of different driving mechanisms, such as Piezo-electric, electrostatic, magnaplanar, ribbon, plasma, etc. Of the many types of current speaker design (driver mechanisms), the most common and least expensive are the dynamic radiator and piezo-electric. The instant invention contemplates exclusive use of these two types of speaker design.

In 1947, Preston, in U.S. Pat. No. 2,426,948, disclosed a Coaxial Dual-Unit Electrodynamic Loud Speaker in which the tweeter unit was electrically crossed and capacitively coupled to the woofer unit, and coaxially mounted, so that its permanent magnet supporting base resided within the woofer central pole piece. As with the Olson art, however, Preston continued to arrange the driving coils concentrically and in basically the same transverse plane in which the woofer voice coil resided. A compliant member was used to essentially join the tweeter diaphragm to that of the woofer.

In 1985, two patents issued to House, U.S. Pat. Nos. 4,497,981 and 4,554,414 for a Multi-Driver Loudspeaker. In the first, '981, a multi-driver loud speaker assembly having high- and low-frequency transducers is realized in which the high frequency transducer is directly coupled to the diaphragm of the low frequency transducer and is movable therewith. In the later patent, '414, a multi-driver loud speaker combination includes a first transducer of the dynamic radiator type (previously discussed), which is designed to reproduce sound in the lower portion of the audio frequency range. The radiator of the first transducer included a diaphragm and, concentrically aligned and coaxially mounted therein is the second transducer, or tweeter assembly. A hornshaped base support is mounted on the first transducer diaphragm, a voice coil former, or the dust cap which is generally employed with singular mechanizations of the dynamic radiator type transducers. In his arrangement, House suggests more than one type of orientation of the tweeter assembly with respect to the woofer. Of significant difference from the previously mentioned prior art is the utilization by House of a piezo-electric transducer for driving the tweeter assembly. Later, in this disclosure references will be made to the general art disclosed by House; and, the piezo-electric tweeter driver shall be referred to more casually as "bi-morph" element. The House art, clearly the most relevant art at this date, will be discussed in greater detail and in contrast to the techniques embodied by the instant inventor in realizing this improved, dynamic, bi-morph speaker.

Since the piezo-electric bi-morph element comprises a prominent part of the instant invention, a few words descriptive of its structure are in order. By definition, the driving element of the tweeter loud speaker is known colloquially as a "bi-morph", i.e., a bi-layer, amorphic ceramic element. The bi-morph woofer is composed, essentially, of two ceramic plates in the form of discs, with a voltage conductor (plane) sandwiched therebetween. When a driving electromotive force is applied to both of the ceramic plates and at the conducting voltage plane, piezo-electric effect causes flexure of the element in a direction normal to the plane of the element. The tweeter diaphragm cone apex is affixed proximate the center (and maximum flexure point) of the bi-morph wafer. Thus, the diaphragm of the tweeter translates the dynamics of the bi-morph element radially outward from its apex towards its larger or major perimetral margin. Conventionally (in the current art), the larger perimetral margin of the tweeter, or any mid-range speaker, is joined to the diaphragm of another speaker by some compliant element. This is a characteristic of the structural art employed by Olson, Preston and House with but a singular exception, that being where House chooses to mount the bi-morph element on the dust cap in one instance and, although he does not clearly disclose how, at the woofer voice coil former (presumably on the rim or margin thereof) in another. Irrespective of the location for mounting the driver element, two factors remain consistent throughout all of the prior art, relative to the mounting of the tweeter driver and whether it be of the coil type or the bi-morph element. In all prior coaxial tweeter/woofer relationships, the diaphragm of the tweeter is clearly in front of the diaphragm of the woofer, and the driving element of the tweeter, particularly with the bi-morph element type, is (in all but one instance) mounted forward of the woofer voice coil former. The singular instance in which the bi-morph element is not expressly mounted forward of the woofer voice coil former is in the last referenced suggestion of House wherein he vaguely refers to the attachment of the bi-morph driver to a point on the Voice coil former; but the reference is too terse. House does not explain either how the attachment is to be made or if there will be a change in his general tweeter/woofer diaphragm arrangement. It is presumed by the instant inventor, therefore, that House merely intended to anchor a point or locus of points of the bi-morph element on the outer rim of the voice coil former.

The instant inventor believes that because Olson and Preston did not have the advantage of the bi-morph element, they were not impelled to greater innovation in the coaxial mounting scheme that they pioneered. Because House was concerned with the structural dynamics of plural tweeters or mid-range speakers, he strayed somewhat from the pure coaxial mounting scheme and thus failed to give greater definition to a passing fancy such as mounting the bi-morph element on (to) the woofer voice coil former. The instant inventor, wishing to develop a more highly efficient and higher fidelity coaxial arrangement was inspired to perform a wide variety of experiments with placement and attachments of the bi-morph driven tweeter. The instant invention is the result of his efforts. Hereinafter the instant invention will be briefly disclosed, and in the following Detailed Description of the Preferred Embodiment, a comparison to the prior art of House shall be made and the benefits and improvements of the instant invention shall be clearly discussed and detailed.

SUMMARY OF THE INVENTION

The present invention is a coaxial loud speaker system comprising essentially a woofer and tweeter loud speaker pair in which the dynamic radiator driver, the woofer, and the piezo-electric bi-morph driver of the tweeter assembly are coaxially arranged so that the tweeter bi-morph driving element is attached to the woofer voice coil former, interior of the former in such a way that the motion of the bi-morph driving element is limited to flexure in a direction normal to the plane of the bi-morph disc element. The flexure direction of the bi-morph driving element is coextensive with the longitudinal axis passing through the voice coil former. Further to the present invention, the preferred embodiment contemplates a placement of the tweeter assembly entirely within the woofer voice coil former and such combination clearly contemplates any means of attachment of the tweeter diaphragm cone's larger (major) perimetral margin to the woofer voice coil former. Further to the tweeter diaphragm, the apex of the cone is somewhat flattened and mounted centrally to the bi-morph top or forward disc so that only the bi-morph disc will bend (flex) during excitation and any vibrations will be propogated outward of the center through the tweeter diaphragm with complete uniformity. Compliances used to affix one element of the system to another comprise any compliant member known to those of skill in the industry and having a determinable mechanical compliance. Such a compliant member, an annular element having an internal circumferential groove is used to mount the bi-morph disc or wafer pair inside the woofer voice coil former. This transversely partitions the cylindrical former. A similar, but more flexible compliance is also used to join the outer (major) perimetral margin of the tweeter to the end margin of the woofer voice coil former or on a minor circle proximate the apex margin of the woofer diaphragm. In this manner, the instant inventor realizes the mounting of the tweeter coaxial to the woofer so that the diaphragm of the former is clearly behind the major portions of the woofer diaphragm and, in effect, practically the entire tweeter assembly is mounted within the woofer voice coil former.

BRIEF DESCRIPTION OF THE DRAWINGS

Of the drawings:

FIG. 7 is row-column matrix of cross-sectional schematic representations of several tweeter driving element-diaphragm arrangements, according to the following scheme:

Figures 1A, 1B:
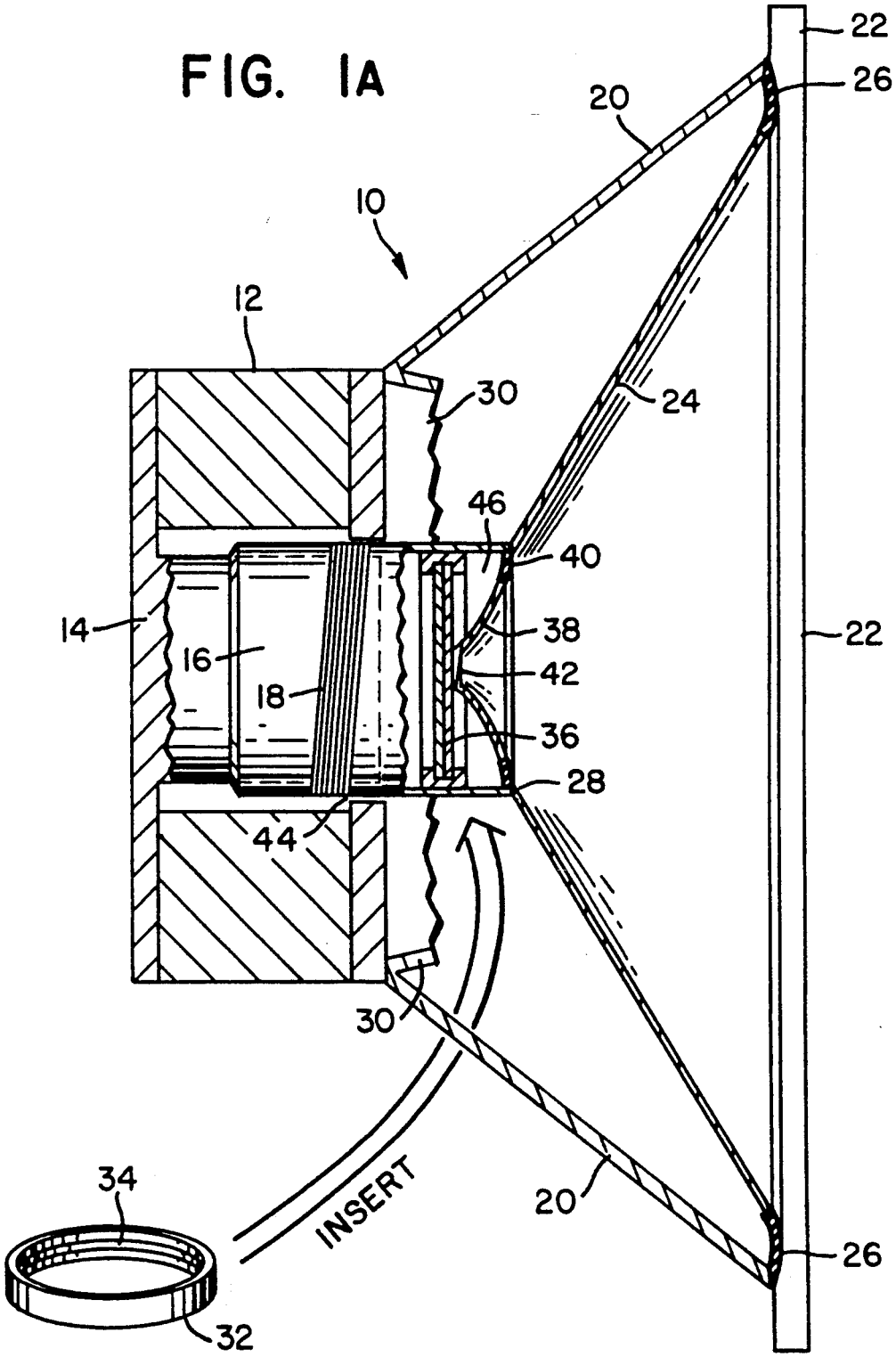
FIG. 1A is a cross-sectional, side elevational view of a multi-driver speaker combination of the instant invention.
FIG. 1B is an isometric detail of the tweeter mounting compliance of the present invention.

a) Rows I, II and III represent, respectively, edge supported driving elements, end-supported or cantilevered driving elements and edge-supported annular driving elements; and b) Columns A, B and C represent cone diaphragm, dome diaphragm and horn-coupled apparatus, respectively.

DETAILED DESCRIPTION OF THE PREFERRED EMBODIMENT

As pointed out in the Summary, the present invention comprises two significant improvements over the prior art. During this Detailed Description of the Preferred Embodiment, the innovative aspects of the instant invention shall be contrasted with the most prominent examples of the relevant prior art and, subsequent to the complete disclosure of the invention, a statement shall be given expounding the benefits derived from each of the discrete differences between the instant invention and all of the prior art, the sum total of the differences constituting the totality of invention herein disclosed and subsequently claimed.

Referring particularly to FIG. 1, a cross-sectional, side elevational view of the instant invention 10, there are clearly depicted the salient elements of an electromagnetic, dynamic radiator loud speaker comprising: annular permanent magnet 12 with projecting central pole piece 14; low frequency (woofer) voice coil former 16; woofer voice coil 18; speaker assembly support frame 20; baffle-mount 22, to which the speaker assembly support frame is affixed; woofer conical diaphragm 24; annular compliance 26, for mounting the larger perimetral margin of the diaphragm 24 to the speaker assembly support frame 20; and the woofer voice coil former 16 diaphragm 24 juncture 28, generally acquired through ordinary adhesive joining methods. Generally, in the art, additional support is afforded the woofer diaphragm 24 by the coupling of a diaphragm cone support 30 between an annular perimeter of the speaker assembly support frame 20 and the woofer voice coil former 16. This additional support also aids in maintaining air gap 44 which allows, in addition to the electrically induced vibration, a motion of the woofer voice coil former in the direction normal to the plane passing through the permanent magnet annulus 12 and, as shall hereinafter be seen, normal to the plane of the bi-morph element 36.

Figure 3B:
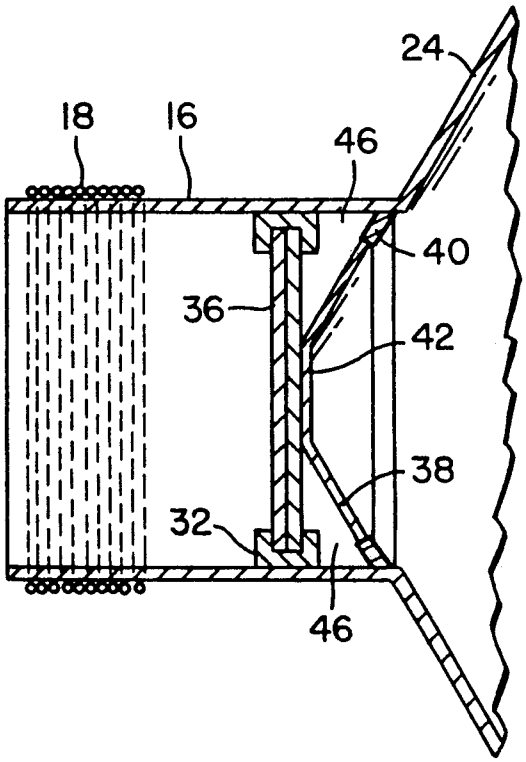
FIG. 3 is 3*a*–3*b* a double, side and front, elevational orthographic schematic view of the present invention.
Figure 3A:
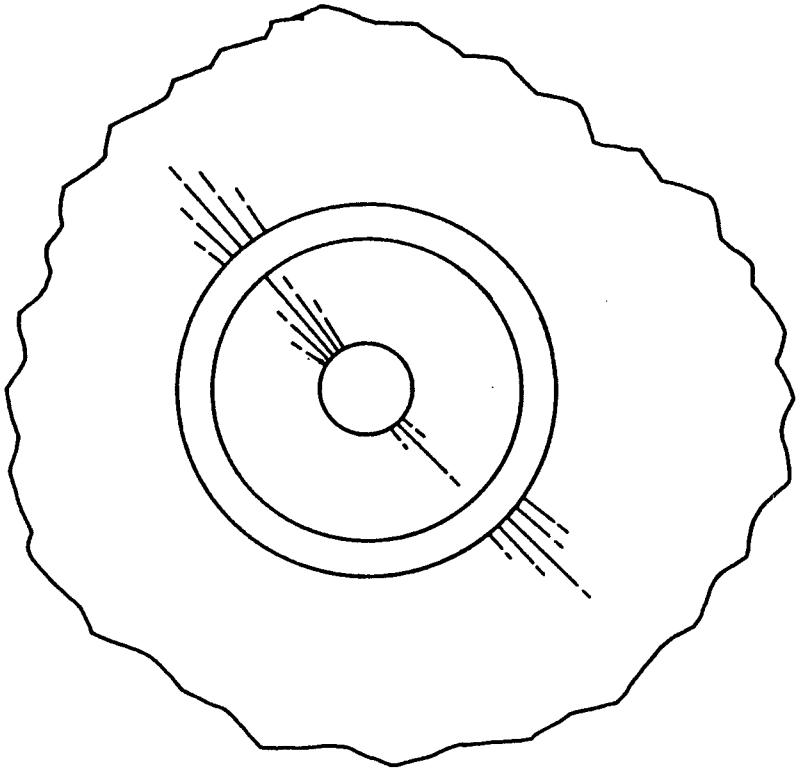

Referring now more specifically to FIGS. 1A–1B in conjunction with FIG. 3, the annular compliance 32, which is used to mount the bi-morph element 36, is shown in isometric detail and projected to its residence within the woofer voice coil former 16, as indicated by the INSERT arrow of FIG. 1B. Annular groove 34, circumferentially interior of the mounting ring 32 provides the capturing framework for the bi-morph element 36. The tweeter conical diaphragm 38 is mounted centrally 42 to the bi-morph element 36. The reader will note that the tweeter cone bi-morph mount 42 is affixed to the bi-morph element 36 at the center of the entire unit, on the axis previously described as the normal to the planes of both the permanent magnet 12 and the bi-morph element 36. At this point, the bi-morph element realizes its maximum flexure along the previously defined normal. The reader should notice that the bi-morph element 36, residing in the tweeter mounting ring 32, is positioned well behind the frontal margin of the woofer voice coil former 16. Once fixed in this position, the tweeter cone 38 is secured to the voice coil former's forward margin by annular compliance 40. Thus, two innovations by the instant inventor are realized at this point of construction: full emplacement of the bi-morph element 36 within the woofer voice coil former 16; and, physical mounting of the tweeter cone 38 within the voice coil former and behind the low frequency conical diaphragm 24 so as to practically form (but for the imposition of annular compliance 40) a continuous conical diaphragm radiating from the center of the bi-morph element 36 to the annular compliance 26, or some suitable juncture of the woofer diaphragm 24 with the speaker assembly support frame 20. It is this unique structure and diaphramatic continuum that gives rise to the improved audio propogation characteristics that shall be described in the discussion of FIGS. 5A, 5B, 6A and 6B.

Figure 2:
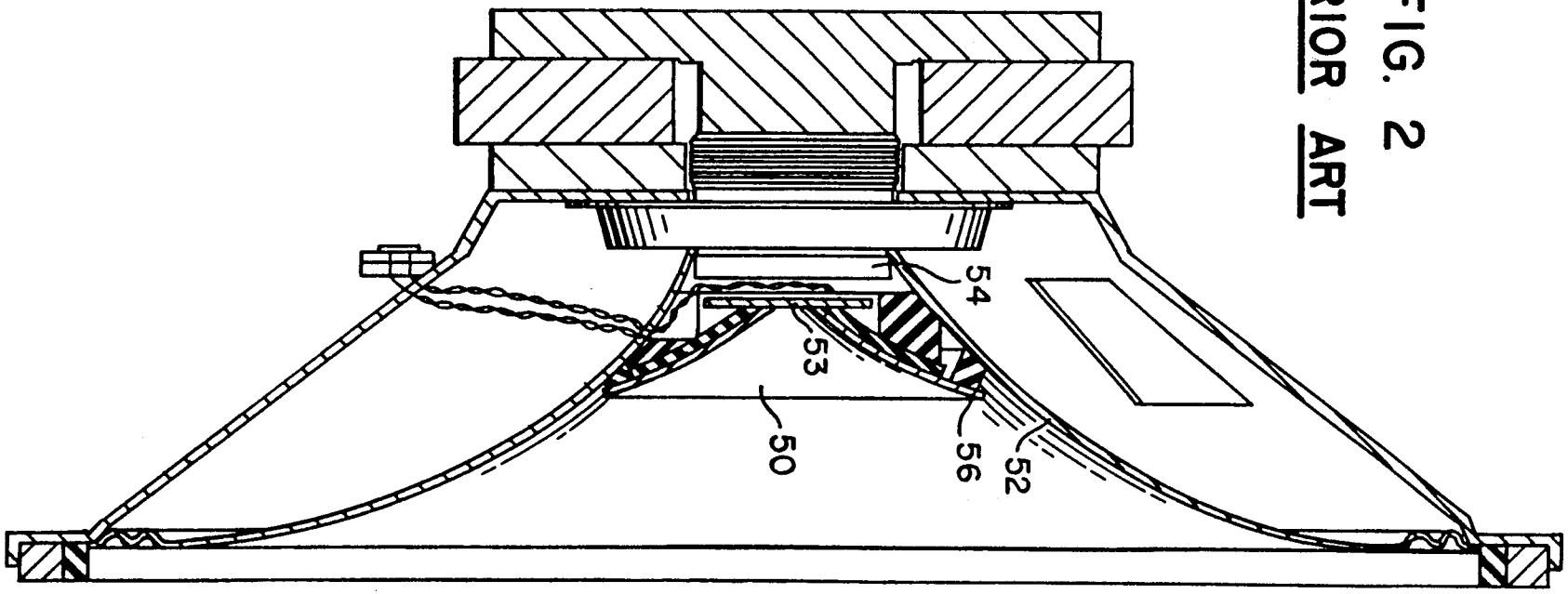
FIG. 2 PRIOR ART
FIG. 2 is a cross-sectional, side elevational view of a preferred prior art embodiment of a multi-driver loudspeaker system.

The most relevant piece of prior art discussed was clearly that of U.S. Pat. No. 4,554,414. A replication of FIG. 1 from '414 is had at FIG. 2 of the instant disclosure and labeled, accordingly, PRIOR ART. Referring to FIG. 2, there is disclosed an assembly which, in general, closely resembles a significant part of the FIG. 1 illustration. Nonetheless, there are significantly different aspects as can be seen in the prior art illustration: its tweeter diaphragm 50 is positioned inside of the woofer conical diaphragm 52 so that it may be said to be clearly mounted in front of the woofer diaphragm; further, the bi-morph element 53 is therefore also mounted forward of and over the woofer diaphragm; the voice coil former 54 is void of any tweeter elements; and the compliant annular mounting structure 56 of the tweeter clearly places it on the woofer diaphragm 52 surface. The latter aspect, the tweeter mount 56, is significant in that an audio distortion will be propagated, a disadvantage clearly avoided and a concomitant problem that is overcome by the instant invention's inside-the-voice coil former tweeter mounting. This aspect of the instant invention will be further addressed in the discussion of FIGS. 5A through 6B.

Figure 4B:
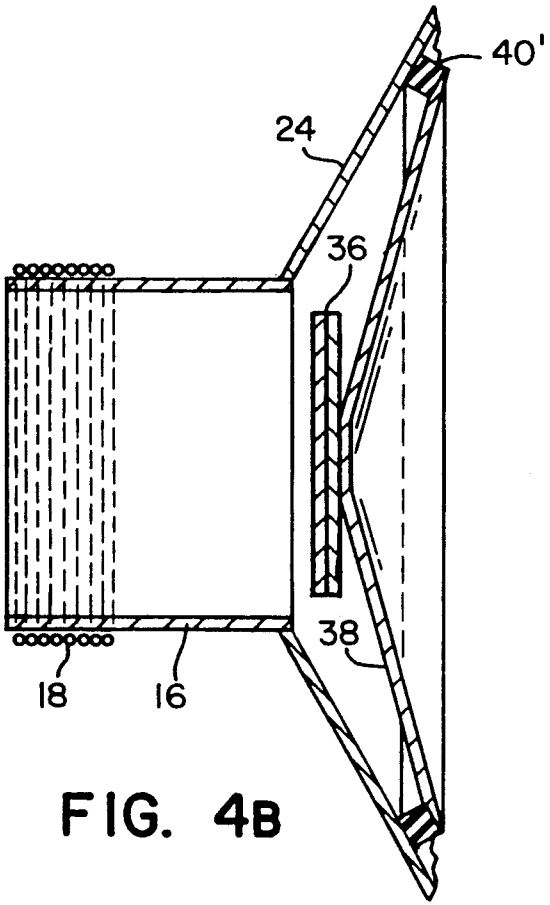
FIG. 4 is 4*a*–4*b* an orthographic schematic of the prior art device of FIG. 2, after the style of FIG. 3.
Figure 4A:
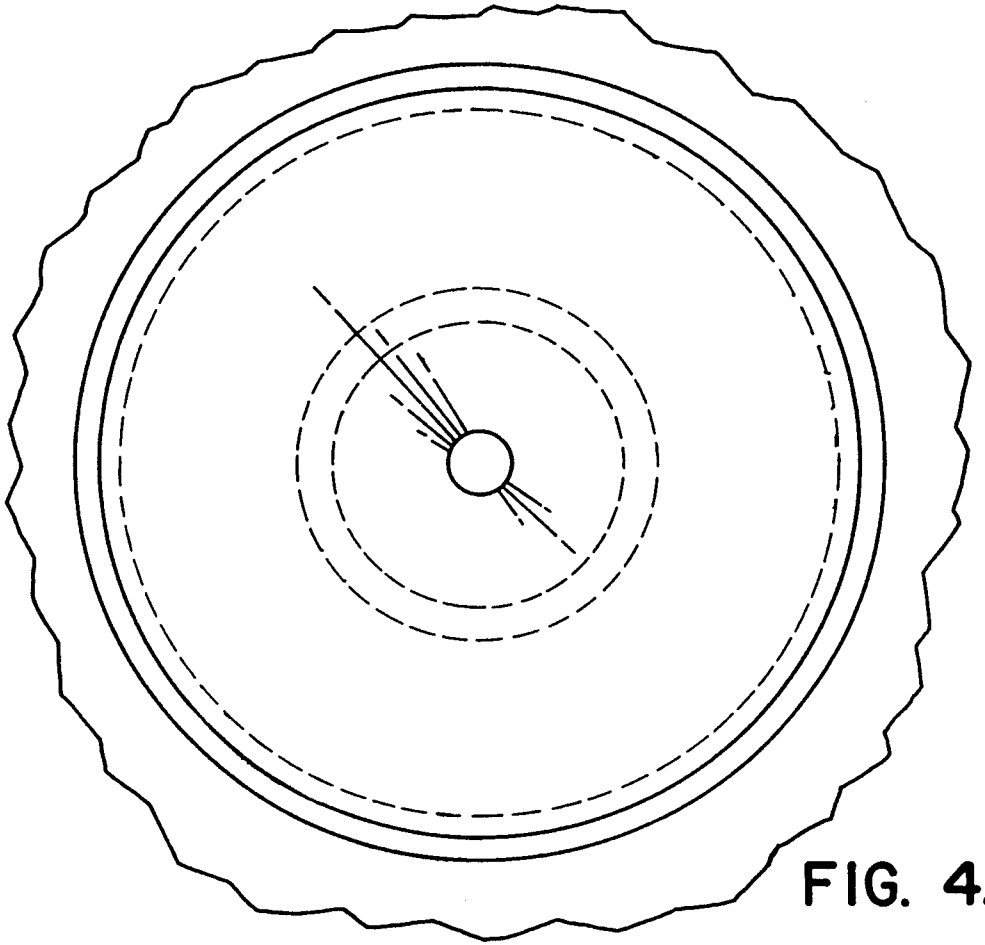

In order to more clearly contrast the standard elements of the prior art with the novel aspects of the instant invention, the following disclosure will have concurrent reference to FIG. 3 and FIG. 4. Where elements of the assemblies are identical, or strongly similar, the same numerical reference shall be used any shall correspond to the nomenclature used in FIG. 1; where differences of subtlety exist, the prime (') notation shall be employed and, where significant differences or novelties exist, there shall obviously be no corresponding nomenclature in the prior art, as depicted in FIG. 4.

As seen in FIG. 3, the salient elements comprise: the high frequency or tweeter bi-morph driving element 36; the tweeter conical diaphragm 38; the unique bi-morph element attachment means 32 within the woofer voice coil former 16; the significantly different tweeter cone outer edge attachment means 40, wherein the tweeter cone is set behind the frontal surface of the woofer diaphragm 24; the woofer voice coil former and diaphragm, 16 and 24; the woofer voice coil 18; and, completely absent from the prior art, the sealed cavity 46 between the bi-morph element 36 and the tweeter conical diaphragm 38. In the prior art depicted in FIG. 4, only five of the previously mentioned elements of FIG. 3 are identical, elements 16, 18, 24, 36 and 38. The prior art, not only that of FIG. 4 but as a whole, lacks: element 32, the bi-morph attachment means and its unique position within the voice coil former 16; and the unique tweeter cone outer edge, compliant attachment means 40. It is depicted as 40' of the prior art in FIG. 4 because, in all prior art, the conical diaphragm of the tweeter is mounted by its perimetral margin to the woofer diaphragm 40' (see the FIG. 4 prior art depiction). Because of this distinction in prior art tweeter mounting, not only are audio distortions created, but it is impossible to acquire a sealed cavity 46 behind the tweeter diaphragm and in front of the bi-morph driving element 36. A sealed cavity (volumetric) may be engineered so as to acquire a resonant cavity that is "tunable". By such tunability, certain desirable audio characteristics, particularly in the high frequency ranges, are achieved by the instant inventor in practicing the present invention. This design device also allows the use of differing, lighter materials for making the tweeter diaphragm, thus allowing a closer approach to the ideal speaker diaphragmatic mass of zero. Because the instant inventor has developed an unique placement of the bi-morph driving element within the voice coil former (air core) and attaches the tweeter diaphragm perimeter to the voice coil former—woofer diaphragm juncture, he has acquired an apparatus giving an increased phase coherence to the audio output of this loud speaker system and, although not approaching the ideal phase coherence of infinity, has achieved significant improvement over the prior art. Until now, all nesting of tweeters and intermediate range speakers within one another has been the norm and, in order to practice this expedient, a significant amount of audio phase distortion has been suffered. That disadvantage has been overcome by the instant invention.

Before departing from the discussion of FIGS. 3 and 4, it is notable that a minor disadvantage of the prior art has been overcome, the tenuous suspension of the bi-morph driving element, as seen in FIG. 4. There it will be noted that the bi-morph element 36 appears to be projected to the left, just in front of the woofer voice coil former 16. Depending upon the orientation of the speaker system, this suspension of the bi-morph element could be said to be either cantilevered or pendulous, or somewhere in between. Ordinary reason tells us that over a period of time, or after a series of undesired vibrations or movements there will be visible distortion of the tweeter cone caused by the torque of the suspended element. Although this diaphragmatic distortion may not be measurably signficant, it will nonetheless be suffered as additional audio distortion in the higher frequency ranges. Clearly, the unique attachment means of the instant invention obviates such distortional damage to the tweeter diaphragm.

Figure 6A:
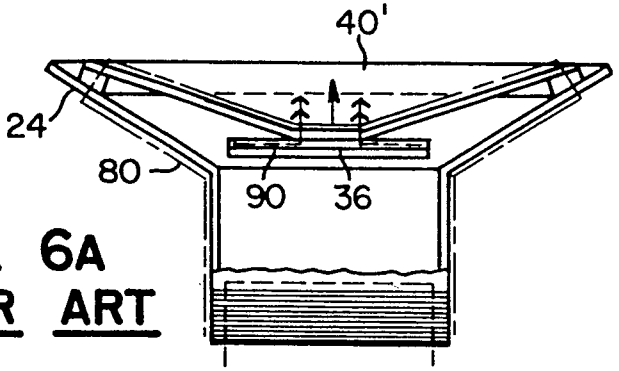
FIG. 6A PRIOR ART
FIGS. 6A and 6B are repetitions of FIGS. 5A and 5B, respectively, but of the prior art device of FIGS. 2 and 4.
Figure 6B:
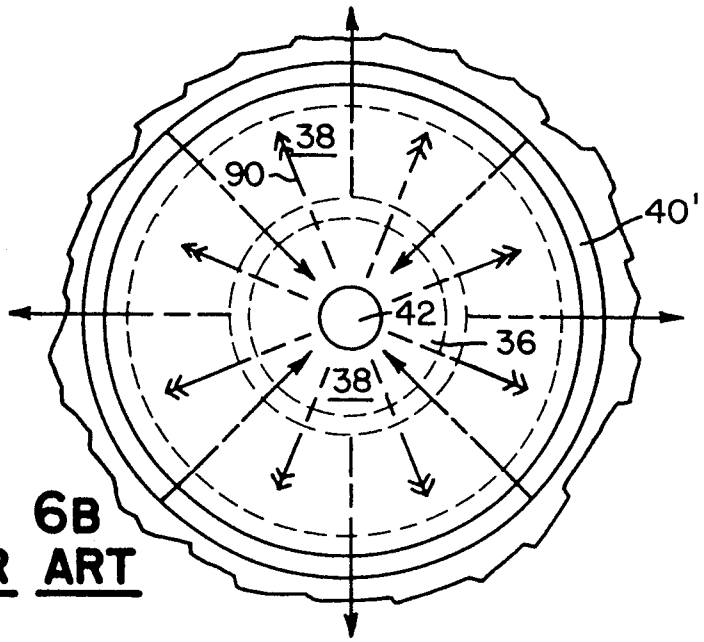
FIG. 6B PRIOR ART
Figure 5A:
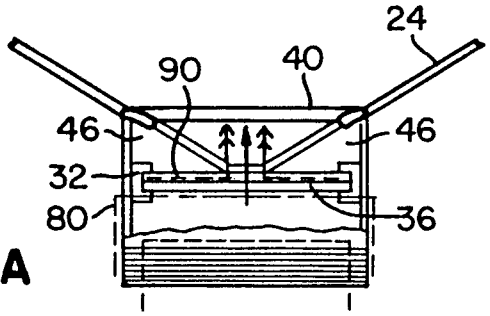
FIGS. 5A and 5B are orthographic schematic illustrations of the present invention depicting sound propogration routes.
Figure 5B:
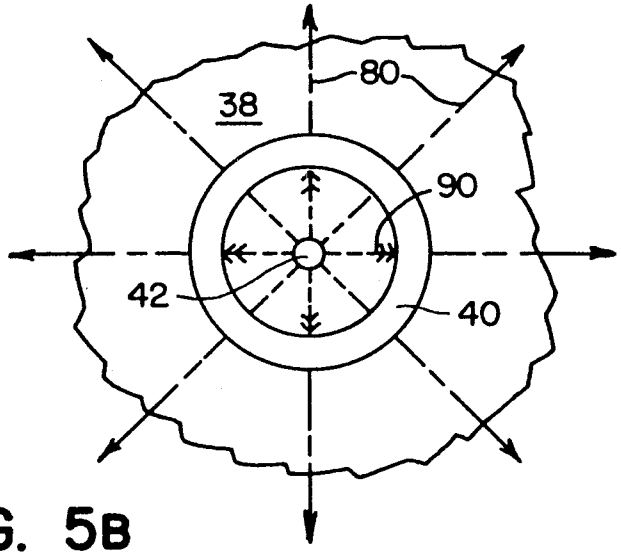

To more clearly describe the distinctive audio propagation benefits that are acquired by the instant invention, FIGS. 5A through 6B, representing both the instant invention and the prior art tweeter mountings are shown in orthographic, schmematic illustration. The direction of high frequency propagation is denoted by short dashed lines 90 and the direction of low frequency propagation is shown by the heavier, long and short dashed lines 80. Referring particularly to FIG. 5A, the instant invention, with its salient elements including the bi-morph element 36 mounting means 32 and the tweeter cone outer edge attachment means 40, develops a propagation flow path of low frequency orignating at the woofer voice coil and in the direction normal to the plane passing through the bi-morph element 36. The LF propagation 80 suffers nearly zero delay as it passes thorough the bi-morph element radially outward of the tweeter cone and radially outward of the woofer cone. FIG. 5B discloses the concurrent propagation of both high frequencies 90 and low frequencies 80 as they clearly appear in phase. In contrast, similar propagation of the high and low frequencies in the prior art, as disclosed in FIGS. 6A and 6B, suffers considerable audio impairment in the crossover frequency ranges. FIG. 6B illustrates how, at the surface of the tweeter, the vibrational characteristics of the low frequency propagation 80 regresse (down) the face of the woofer of the tweeter through the compliant juncture 40' and towards the tweeter base mount 42. Because in the prior art most tweeters are mounted on the surfaces of the woofer diaphragm (or intermediate range speaker diaphragms), there will always be a vibrational wave propagated from the point of juncture, in this case at the compliant mounting 40'. As seen in FIG. 6B, such (reverse propagation will have an adverse effect on the quality of audio results because of the antiphased, interfering relationship projected by the various tweeter and intermediate range speakers on to the woofer pattern.

Having described in detail the elements of the instant invention, and before disclosing the latest variations developed by the instant inventor in order to exploit the differences between the present invention and the prior art, it is appropriate to amplify somewhat on the discrete differences and relate the benefits obtained by practice of the instant invention. Consider first the difference between the instant invention and the art disclosed in an earlier House patent ('981), namely in the instant, the driver element of the (bi-morph) tweeter driven directly by a connecting element (bi-morph attachment means 32) other than the woofer diaphragm (House) and attached thereby to the voice coil former of the woofer. The benefits derived through the realization of this difference are improved phase response, improved amplitutude response, synchronization of the sound wave propagation direction in both woofer and tweeter, removal of support stresses from the tweeter diaphragm cone, improved support of the bi-morph driver element and supression of unwanted resonances in the bi-morph assembly. Elaborating respectively, phase response is defined as the timing relationship of the various frequencies and transients as they reach the air in front of the speaker diaphragm. In the House design, the time difference between low frequencies from the woofer and the high frequencies from the tweeter is approximately one millisecond. This corresponds to about an eight cycle shift in an 8 KHZ signal. This large difference is easily perceived by persons having normal hearing and is describable as a "smearing" of the sound. Such a deleterious effect makes it very difficult (or impossible) to hear each instrument in an orchestra as a separate sound source. However, because of the direct coupling between the woofer voice coil former and the tweeter bi-morph edge in the present invention, the time difference between the signals is only about, or less than, 100 microseconds, which results in a much more accurate wave form in the case of multiple frequencies and transients that are typical of orchestral music. Thus, every instrument in a full orchestra is readily identifiable. Amplitude response is the relative size or intensity of the various frequencies and transients which are superimposed upon one another. In particular, frequencies in the crossover region (approx. 3–5,000 Hz) are improved through the design of the instant invention. In this frequency region, driving force is originating in the woofer and tweeter simultaneously, and excitation is had at the diaphragm surface (center of the tweeter diaphragm) with less than 100 microsecond delay of the woofer signal. This results in the two identical signals being added "in phase", which results in the proper amplitude. The audible effect is that instrumental sounds are reproduced with their original timbre or tonality. Thus, it becomes easier for the listener to distinguish the different types of say, horn instruments, (i.e., french horn, trombone, etc.). Relative to synchronization of sound wave propagation direction in the woofer and tweeter, it should be understood that all sound energy originates in the center of the tweeter cone (for the tweeter diaphragm), the low and high frequencies both propagating radially outward along the surface of the tweeter diaphragm cone. This results in improved "imaging"60 of the sound as a "point source"; and allows the listener to more accurately place the sound source in the spacial position "created" by the stereo effect. Relative to the relief of support stresses from the tweeter diaphragm cone, attachment of the bi-morph discs to the woofer voice coil former removes the burden of support from the tweeter cone and places it on the woofer voice coil former. The tweeter cone thus has only the function of transmittal of energy to the air and can therefore be made lighter, as previously mentioned. All other things being equal, the lighter the moving mass of the transducer, the better it is-able to handle quickly changing inputs (high frequencies). This results in better high frequency response. Finally, relative to the improved support of the propagation benefits that are acquired by the instant bi-morph driver element, supression unwanted resonances in the bi-morph is readily apparent. At high power levels, the bi-morph discs in the House designs will oscillate in the axial direction relative to the movement of woofer voice coil former. This results in an audible resonance (of that) frequency, and which is not present in the original voltage wave form. The design of the instant invention keeps the bi-morph discs in nearly exact coincidence with the woofer voice coil former, and thus eliminates such a resonance. The audible effect is a cleaner sound. Also, it should be noted that the addition of the bi-morph disc coupling ring gives the engineer more opportunities to control the resonances of the bi-morph discs themselves, which results in a smoother and less "peaked" frequency response in the high frequency region.

A second notable difference between the instant invention and the prior art is that of the tweeter cone outer edge support by an annular ring which is (compliant and) highly absorptive of vibrations in the crossover frequency region and which is not required to contribute significantly to tweeter cone structural support in the axial direction. The benefits are a reduction of interference between woofer and tweeter diaphragm cones, attainment of an annular ring of lower cost and mass giving less critical vibrational characteristics, and improved supression of unwanted oscillatory modes of vibration in the tweeter cone. As above, an amplification of the aforementioned benefits are hereinafter addressed. Removal of the support burden of the bi-morph discs from the tweeter cone allows the use of a very pliable (highly compliant) annular ring which supports the tweeter cone in the radial direction only. Since the sound waves from the woofer diaphragm are primarily transverse (a factor known to those of ordinary skill), they are nearly entirely absorbed by the annular ring. High frequencies are likewise absorbed as they travel along the tweeter diaphragm. This removes intermodulation distortion from the system, which is audible as an alternating high and low amplitude sound not present in the original wave form. The annular ring in the House design, like much of the prior art, has many functions to perform, including support of tweeter cone and bi-morph element, transmittal of low frequency sounds from the woofer diaphragm, and partial transmission and absorption of sounds from the woofer in the crossover frequency region. It is extremely difficult to optimize all of these functions simultaneously; thus, in the instant invention, use of the annular mounting ring 32, which has only the functions of supressing unwanted resonances in the tweeter cone, and of sealing the front of the tweeter cone (see FIG. 1 description-adhesive juncture 28) from the back of the tweeter cone, significantly decreases the number of functions that must be performed. The ring of the instant invention has no transmittal requirements between the woofer and tweeter diaphragms; this is a significant improvement and a departure from the prior art. Relative to the mass of the annular ring, that of the House design is about two to three inches in diameter, and must be fairly rigid in order to support the entire tweeter assembly. This means that its mass must be fairly high. The annular ring of the instant invention has a diameter of approximately one inch, and has practically no support requirement. Its mass would be a small fraction of the prior art designs. The audible result is a better high frequency response. Relative to the last benefit, at high power levels, all diaphragm cones are subject to "cone break-up". The instant design utilizes an annular ring which is optimized for support in the radial direction, and it is better able to control the cone break-up which occurs primarily in the radial direction. The resultant benefit in this case is a cleaner sound with lower distortion relative to the original wave form.

The third notable difference, that wherein the tweeter cone outer perimetral edge is mounted flush with the surface of the inner edge of the juncture between the woofer cone and the voice coil former, provides rather extensive benefits, one of the most notable being less dissipation of woofer energy. In all of the House designs, the annular ring which supports the tweeter is attached to the woofer diaphragm at some point between the woofer voice coil former and the woofer diaphragm outer edge. This means that the transverse wave in the woofer diaphragm will be partially absorbed by the annular ring. The instant invention design calls for the annular ring to be attached to the woofer voice coil former, which conducts energy as a longitudinal wave. Longitudinal waves are much more efficient transmitters of energy than transverse waves, in general. The audible result is the benefit of higher "bass" output for a given level of input voltage (i.e. higher efficiency). Another benefit (of the third difference recited above) is improved vibrational modes of the woofer cone. Since the instant design makes no attachment to the woofer diaphragm, there is no effect on the woofer diaphragm's conduction of the low frequency transverse waves, making it easier to engineer the woofer cone for optimal sound characteristics. The audible result of this improvement is therefore a cleaner bass sound without coloration from unwanted resonances. A major and yet another benefit is the lack of confined air space between the woofer cone and the tweeter cone, thus reducing unwanted resonances. Prior art designs, including all of the House designs, have a partially confined air space in the area mentioned. This confined air space will have its own resonances in the audible frequencies, and will be heard through the tweeter diaphragm cone. The instant invention does not have an air space in the area mentioned. Still another benefit is acquired: smaller tweeter diaphragms result in better high frequency dispersion and lower mass. All other things being equal, the smaller the source of a sound, the more it acts as a point source, which has the maximum degree of dispersion of sound. Dispersion is measured as the amount of variation of the amplitude of a sound as the measuring device (the ear) is moved off-axis from the sound at a given distance. The ideal dispersion would be zero variation of the amplitude of the received sound through a wide angle from (off) the axis of the sound producing device (diaphragm center). The audible benefit in the instant invention is a larger field of sound in a listening room so that the sound does not vary significantly as one moves about the room. The audible benefit of a lower mass is that articulated above in discussing the removal of support stresses from the tweeter diaphragm cone. A fifth benefit to be derived is that the woofer cone can be made lighter. This means that, for a given woofer diameter, the upper frequency limit that it will reproduce is higher. The crossover region can therefore be moved to a higher frequency range. The audible benefit here derives from the fact that the further away the crossover region is from the middle of the frequency range, the less sensitive the ear is to small unwanted sonic effects which are inevitable in any crossover region. It is well known that the human ear is most sensitive to sounds in the area of 200 to 2,000 Hz. A sixth benefit, and one which is readily apparent, is that the woofer cone has greater effective area. Since the diameter of the tweeter cone in the instant design is much less than that of the House design (one inch vs. several inches), the woofer cone is not covered by any portion of the tweeter cone; indeed, the tweeter cone is behind the woofer cone. The audible benefit in this instance is a resultant greater bass sound output for a given input voltage. A seventh benefit, derived from the placement of the entire tweeter assembly inside the voice coil former, is that the producing entity is required to align only two separate structures, the bi-morph element within the voice coil former and the two diaphragms, the tweeter secured to the forward perimetral edge of the voice coil former, and the woofer according to ordinary practice. Two remaining benefits of the tweeter cone outer perimetral edge mounting (at the woofer cone-voice coil former junction) provide clear advantages over the prior art, particularly that of House. They are the fact that that the angle between the woofer and tweeter cones can be increased to 180 degrees; and that the smaller tweeter diaphragm may be produced from materials having less mass and greater rigidity. In comparing the drawings, these advantages become evident. Since the tweeter diaphragm in the instant invention can have the same rate of flair (divergence) as the woofer cone, they constitute the same conical geometry (a continuum). The House design requires two different flair rates in order for the tweeter cone to fit on the woofer cone. Such is also evident from the other prior art disclosures beginning with Olson, and clearly constitute a limiting factor in all of the prior art. The audible benefit to be gained in the instant invention is that of greater continuity of the sound wave in the air at the juncture between the tweeter cone and the woofer cone. This results in a cleaner sound and better dispersion characteristics, particularly as noted in contrasting FIGS. 5A and 5B with FIGS. 6A and 6B. The audible benefit of lower mass and greater rigidity in the tweeter loud speaker has already been discussed and should suffice for this statement of advantages.

A fourth notable difference, the sealability of the air space between the tweeter driver element and tweeter cone provides three unique advantages. Briefly these advantages are: improved support of the tweeter cone against high pressure from the front of the cone; tunability of the volume of the enclosed air confined by the sealing in order to maximize the flatness of the tweeter frequency response; and increased cooling effect on the woofer voice coil. In the House designs, the area near the back surface of the tweeter cone will always have a pressure near ambient atmospheric. As the woofer cone is propelled by high amplitude, low frequencies it will generate very high pressure levels on the front surface of the tweeter cone. This pressure will deform the cone at the rear, since there is no corresponding increase in pressure from the rear of the cone. The instant invention is subjected to the same very high pressure levels from the front of the tweeter cone, but since the rear of the tweeter cone can be sealed, there is a corresponding increase in pressure at the rear of the tweeter cone as it is deformed. Thus the resulting deformation is greatly limited by the backpressure developed in the confinement of the instant invention's design. The benefit to be obtained is that of a great reduction in distortion of the high frequency signals. As previously mentioned, the air space, that is the enclosed cavity confinement) behind the tweeter and in front of the bi-morph element, will have its own resonant frequencies in the very high frequency region. Thus, by adjusting this volume, it is possible to "smooth out" the frequency response in the very high frequency region. Increased cooling effect on the woofer voice coil is realized because there is a smaller air space in the instant invention immediately in front of the center pole of the permanent magnet (which resides inside the woofer voice coil), and behind the sealed bi-morph disk. When the bi-morph disk flexes coextensive to the center pole axis of the magnet, the smaller air space creates a higher velocity of cool air flow on both sides of the voice coil former and out through the cone support of the woofer. The audible benefit gained here derives from greater power handling capacity of the woofer and an expected longer voice coil life.

Those of ordinary skill will recognize that there are many other differences that can be noted between the prior art and the instant invention along with the concomitant benefits or advantages of such differences. It is beyond the scope of the instant disclosure to dwell long or to go into extensive design methodology; suffice it to note that those of ordinary skill will have little difficulty in relating such differences as the lack of a dust cap to the benefits derived (that is, lower moving mass) by comparison of the instant disclosure with those of the prior art. Practice with the invention shall make other design variations and advantages rather self evident. For the edification of the reader, the instant inventor commends the alternative embodiments and concepts of FIG. 7. As of this writing, varying degrees of success have been obtained by the instant inventor employing the illustrated variations in driving element support and tweeter diaphragm design and coupling. The results of his continued efforts shall be disclosed and claimed in a subsequent patent application that is somewhat beyond the scope of this present disclosure.

What is claimed is:

1. In a multi-driver loud speaker combination comprised of a first dynamic loud speaker having a voice coil wound about a hollow, cylindrical voice coil former with a conical diaphragm attached at a forward perimetral edge of the former and at least one higher frequency responsive loud speaker having a planar driving element with a diaphragm attached thereto, the higher frequency responsive loud speaker mounted coaxially with the voice coil, the improvement comprising securing means for fixedly disposing and securing the planar driving element and the higher frequency responsive loud speaker diaphragm within the interior of the former so that the diaphragm of said higher frequency responsive loud speaker reposes rear of the forward perimetral edge of the former and wholly to the rear of the diaphragm of said first dynamic loud speaker while said driving element resides transversely and totally within the voice coil former; and compliance means for securing the driving element inside the former and attaching the higher frequency responsive loud speaker diaphragm to the former at least proximate the forward perimetral edge of the former, whereby a cavity is defined by opposing surfaces of the former, the driving element and the higher frequency responsive loud speaker diaphragm.

2. The invention of claim 1 wherein said driving element is a piezo bi-morph wafer.

3. The invention of claim 2 wherein said means for fixedly disposing said planar driving element comprises a closed, compliant annulus containing a groove therein for seating said bi-morph wafer therein, said annulus set into direct contact with surfaces of the interior of the former.

4. In a multi-driver, coaxially mounted loud speaker system having a lower frequency responsive loud speaker comprising a diaphragm that extends outward from a hollow voice coil former and in which at least one higher frequency loud speaker driving element resides completely within the voice coil former, a continuous conical diaphragm design feature comprising means for compliantly fixing a conical perimetral rim of a diaphragm of said higher frequency loud speaker proximate a forward outer edge of the former from which outer edge there extends the lower frequency speaker diaphragm and securing means for disposing the higher frequency speaker driving element totally within and on the former, whereby outwardly extending essentially conical surfaces of the higher frequency loud speaker diaphragm reside substantially inside the former and form a continuum, at the former outer edge, with outwardly extending diaphragm surfaces of the lower frequency loud speaker.

5. A method for mounting a higher frequency responsive loud speaker with an essentially conical diaphragm means and driving means within the interior of a hollow, cylindrical voice coil former which is compliantly fixed to a diaphragm of a lower frequency responsive loud speaker so as to acquire a cavity, said cavity located between a point of fixing said higher frequency driving means within the former and the diaphragm means of said higher frequency responsive loud speaker, said method comprising the steps of closing the interior of the former by fixing a full partition transverse a longitudinal axis of the former between a forward and a rear perimetral edge thereof, and further, compliantly fixing an entire outer perimetral edge of said higher frequency responsive loud speaker conical diaphragm means about a circumferential surface of the former located proximate the former forward perimetral edge and on a periphery that is formed by said former and the compliantly fixed lower frequency responsive loud speaker diaphragm.

6. In a coaxially mounted, multi-driver loud speaker assembly, a resonant cavity formed by the method of claim 5, said cavity situated essentially between and bounded by a planar driving element of higher frequency responsive loud speaker disposed transversely in a hollow lower frequency voice coil former, the hollow voice coil former and a closed, continuous surface of a diaphragm of said higher frequency responsive loud speaker which is connected to the planar driving element.

7. The invention of claim 6 wherein said driving element is a piezo bi-morph wafer.

8. The method of claim 5 wherein fixing a full partition comprises mounting a bi-morph wafer in an annular compliance ring and further, disposing said ring containing said wafer securely within the interior of the former in order to fix said full partition.

9. A loudspeaker driver comprising a first driver for a dynamic radiator including a voice-coil former and a second driver having a flexible planar driving element, said second driver planar element mounted compliantly about its periphery inside the voice coil former of said first driver by means which allows said planar element to flex independently of, but move with, said first driver.

* * * * *